US012781972B2

(12) United States Patent
Hu

(10) Patent No.: US 12,781,972 B2
(45) Date of Patent: Nov. 3, 2026

(54) RANGEHOOD WITH COMBINED AIRFLOW DIRECTOR AND GREASE TRAY

(71) Applicant: Sine Kon Hu, Toronto (CA)

(72) Inventor: Sine Kon Hu, Toronto (CA)

( * ) Notice: Subject to any disclaimer, the term of this patent is extended or adjusted under 35 U.S.C. 154(b) by 365 days.

(21) Appl. No.: 18/402,557

(22) Filed: Jan. 2, 2024

(65) Prior Publication Data

US 2025/0216088 A1 Jul. 3, 2025

(51) Int. Cl.
*F24C 15/20* (2006.01)
*F04D 19/00* (2006.01)

(52) U.S. Cl.
CPC ..... *F24C 15/2042* (2013.01); *F24C 15/2035* (2013.01); *F04D 19/002* (2013.01)

(58) Field of Classification Search
CPC . F24C 15/2042; F24C 15/2035; F04D 19/002
USPC ..... 126/299 R
See application file for complete search history.

(56) References Cited

U.S. PATENT DOCUMENTS 4,098,616 A * 7/1978 Dorius ..... B08B 15/02 454/67
5,205,279 A * 4/1993 Brown ..... F24C 15/2042 454/67
5,537,988 A * 7/1996 Lin ..... F24C 15/20 126/299 R
5,979,436 A * 11/1999 Chiang ..... F24C 15/20 126/299 R
2004/0194778 A1* 10/2004 Yeung ..... F24C 15/20 126/299 R

* cited by examiner

*Primary Examiner* — Avinash A Savani

(57) ABSTRACT

The invention provides an improved kitchen rangehood for installation above a cook top. The rangehood has a housing and an exhaust fan assembly mounted therein. The exhaust fan assembly may include a cyclonic axial fan for drawing air and cooking fumes into the rangehood and expel outside the kitchen. A filter unit may be provided at the opening formed at a lower edge of the housing to reduce condensation and accumulation of grease on to the exhaust fan and the interior of the rangehood. A combined fan airflow director and grease tray is mounted below the exhaust fan assembly and between the fan and the filter to increase the airflow in and around the rang hood and to improve the cyclonic motion of the airflow and to assist collection of grease dripped down from the exhaust fan and the interior of the rangehood.

16 Claims, 10 Drawing Sheets

RANGEHOOD WITH COMBINED AIRFLOW DIRECTOR AND GREASE TRAY

FIELD OF INVENTION

The present invention relates to the field of kitchen appliances and, in particular, to an improved kitchen rangehood with a combined fan airflow director and grease tray.

BACKGROUND OF INVENTION

Kitchen rangehood is widely used in modern kitchens. Generally, it is installed on top of a cook top with a cooking surface or stoves. An exhaust fan unit is mounted inside the housing of a rangehood. When the exhaust fan is energized, the fan draws in the air below it, together with burned gas fuel and fumes (if gas fuel is used), steam or moisture, grease particles, smells and odors etc resulting from cooking and/or burning gas fuel ("cooking fumes"), into the rangehood and expel the cooking fumes outside the kitchen through an exhaust duct. Over time, grease contained in the cooking fumes tends to accumulate inside the rangehood and/or on the fan unit, which will require cleaning. Accumulated grease also may drip down from the interior of rangehood and/or the fan unit, especially when the cook top is heated. In addition to the possibility of ruining the food being cooked, grease dripping down from the rangehood onto a hot cooking surface also may be a fire hazard.

Filters are used for preventing the grease from reaching the inside of the rangehood or the fan, but it may reduce efficiency of the exhaust fan. A user may opt to remove the filter for increased exhaust effect. But removing the filter may expose the fast-rotating fan blades without any covering and thus increase the chance of injuring the consumer.

In some rangehood designs, a grease cup mounted to the center of a fan cover may be provided to capture grease dripped down from the fan. But this may not be effective in collecting grease thrown to the interior of the rangehood by the centrifugal force of the fan blades. Providing an additional grease cup would also increase manufacturing cost and the final consumer cost. A user also would be required to spend extra efforts to remove, clean and remount the grease cup.

The forgoing creates challenges and constraints for providing an improved rangehood that have optimized exhaust function, ease of cleaning, reduced fire hazard and improved safety to prevent injury. There is therefore a need to provide an improved rangehood as compared to the existing art. It is an object of the present invention to mitigate or obviate at least one of the above mentioned disadvantages.

SUMMARY OF INVENTION

The present invention is directed to an improved kitchen rangehood with a combined fan airflow director and grease tray. A broad aspect of the present invention involves an improved range hood. In a preferred embodiment, the present invention provides a range hood that includes an airflow director mounted at the lower side of the range hood to direct air flow drawn into the range hood. The airflow director is shaped as a grease collector for collecting grease dripping down from the range hood and/or the fan inside the range hood. The airflow director is also shaped and positioned to promote a cyclonic airflow inside the rangehood.

In an aspect of the invention, there is provided an improved kitchen rangehood. The rangehood has a housing, an exhaust fan assembly mounted inside the housing, and an airflow director. The housing has outside walls defining a cavity for venting air and cooking fumes from the cook top, and includes a divider to divide the cavity into a first chamber and a second chamber. The divider has an aperture formed therein to permit air communication between the first chamber and the second chamber. The first chamber has an inlet opening for receiving the air and cooking fumes. The exhaust fan assembly has an ingress opening connected to the first chamber and an egress opening connected to the second chamber. The airflow director is mounted between the exhaust fan assembly and the inlet opening. The airflow director has a central opening and a ring trough formed around the central opening. The central opening permits the air and cooking fumes to pass therethrough and drawn by the exhaust fan assembly into the first chamber. The ring trough has an inner wall, a radially outwardly spaced outer wall, and a bottom wall connecting the inner wall and the outer wall to form the ring trough. The inner wall is shaped for directing the airflow and fumes toward the central opening, and the ring trough forms a grease tray and positioned below the exhaust fan assembly for collecting grease condensed on and dripping down from the exhaust fan assembly and the housing.

The exhaust fan assembly may include an axial fan that has a ring wall housing which may be concaved radially inwardly towards a central axis of the axial fan. The inner wall of the trough may have a trumpet-like shape and form a trumpet-like air guide, with the larger opening of the trumpet-like air guide facing away from the axial fan. The trumpet-like air guide may be concaved radially outwards toward the interior of the ring trough.

The airflow director may include a central hub disposed in a central location of the central opening which divides the central opening into an annular opening and a central portion occupied by the central hub. The airflow director further comprises a protective grill which also connects the central hub to the airflow director. The width W of the trough, the width w of the annular opening, and the radius of the central hub may be sized to have a ratio of about 1:2:0.5.

The airflow director may be mounted to the housing in such a way to space the inside periphery of the annular trough away from the axial fan along an axial direction. The inside periphery may be spaced from the axial fan at a distance about 1/10 to 1/2 of the diameter of the ring wall, or at a distance of about 1/3 or 1/4 of the diameter of the ring wall.

In other aspects the invention provides various combinations and subsets of the aspects described above.

BRIEF DESCRIPTION OF DRAWINGS

For the purposes of description, but not of limitation, the foregoing and other aspects of the invention are explained in greater detail with reference to the accompanying drawings, in which.

DETAILED DESCRIPTION OF EMBODIMENTS

Figure 1:
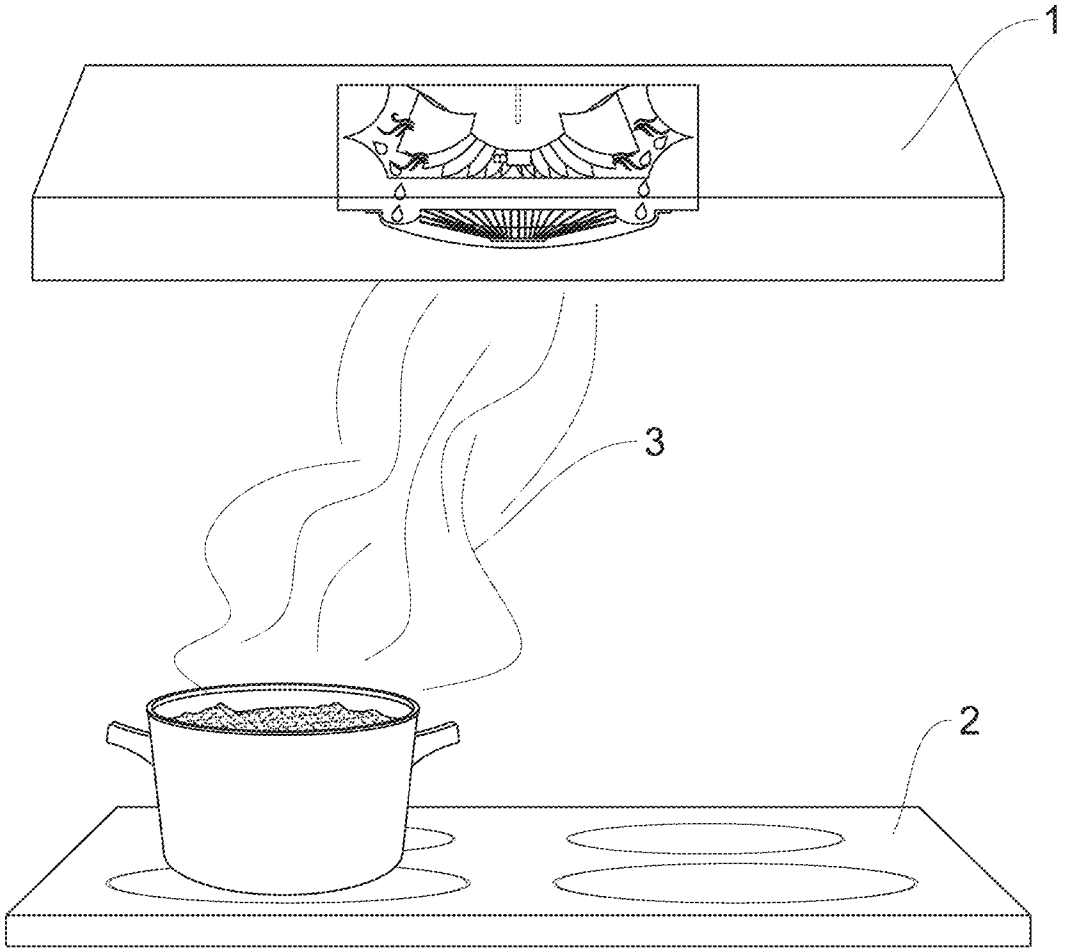
FIG. 1 is a schematic diagram illustrating a general environment wherein a kitchen rangehood is installed above a cook top.

The description which follows and the embodiments described therein are provided by way of illustration of an example, or examples, of particular embodiments of the principles of the present invention. These examples are provided for the purposes of explanation, and not limitation, of those principles and of the invention. In the description which follows, like parts are marked throughout the specification and the drawings with the same respective reference numerals.

As used herein, unless specifically stated or referenced to a particular figure (for example, as shown in that particular figure), in general reference to the direction "up" and "down", or the spatial arrangement "above" and "below" or "higher" or "lower," is made when a range hood is in an installed position, i.e., when it is installed above a cook top. In this arrangement, the direction "up" generally refers to the direction from the cook top to the range hood and the direction "down" generally refers to the direction from the range hood toward the cook top. Similarly, "horizontal" generally means a direction level with the cook top or orthogonal to the direction of gravity and "vertical" generally means a direction orthogonal to a horizontal direction. For example, when references are made to surrounding environment, such as drawing the cook fumes "upwards", the term "upwards" here means along a direction generally from the cook top to the rangehood. When reference is made to grease dripping "down", the term "down" here means the vertical direction from the rangehood towards the cook top. As yet another example, when references are made to the components of the rangehood or regions of the rangehood, the term "below" used in describing a filter mounted "below" the fan means that the filter is mounted between the fan and the cook top. Those skilled in the art will appreciate that these directional conventions are used for the purpose of facilitating the description and are not intended to limit the description in a literal sense.

In the description reference may be made to the general environment of the invention. Referring to FIG. 1, there is illustrated a kitchen rangehood 1 installed above a cook top 2, which is equipped with a cooking surface or stoves for heating foods, water or other items. A fan mounted in the rangehood 1 draws air and cooking fumes 3 from the cook top 2 into the rangehood and vents it outside the kitchen.

Figure 2:
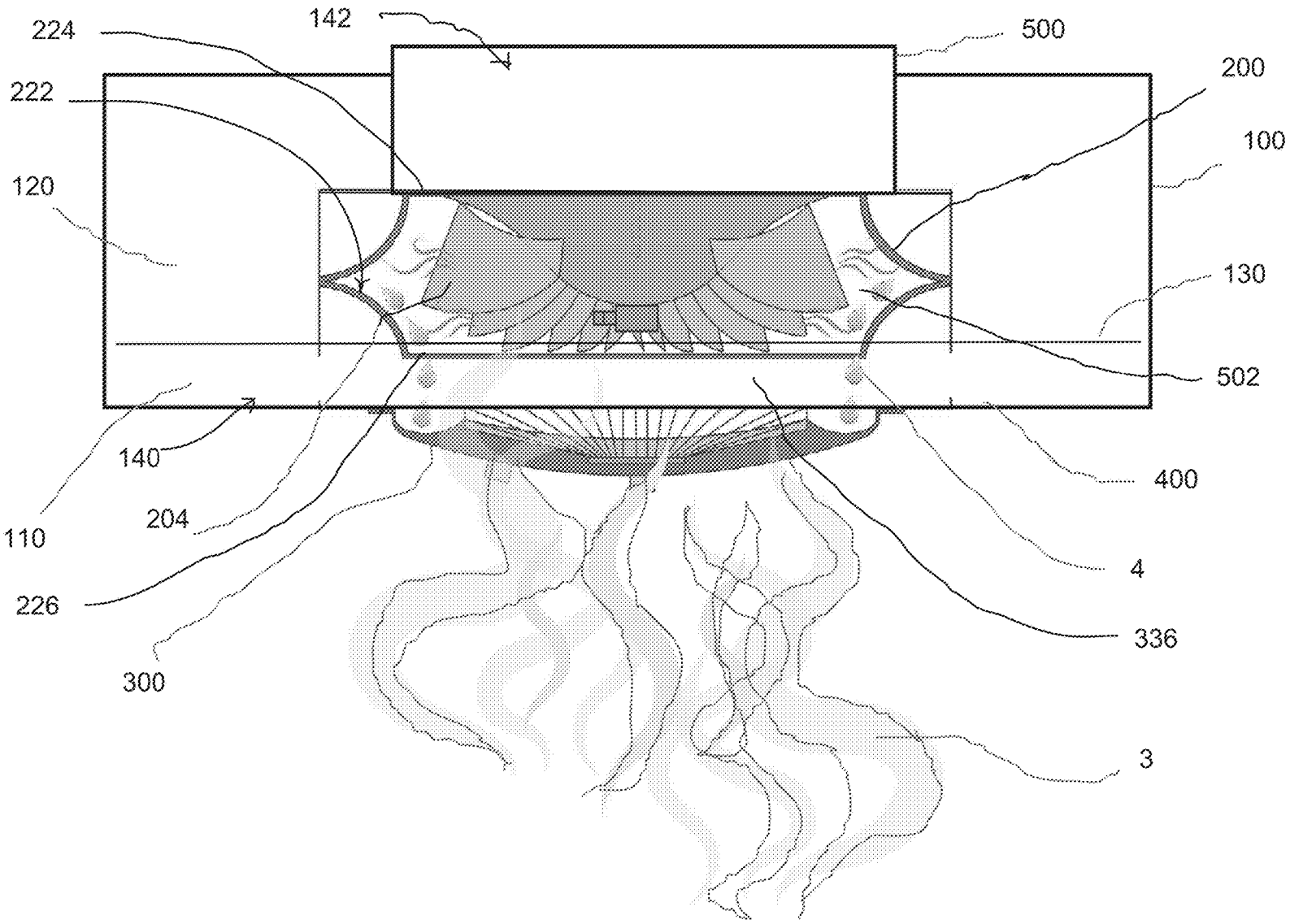
FIG. 2 illustrates schematically several main components of a rangehood shown in FIG. 1.

By way of a general overview, FIG. 2 illustrates in a simplified diagram several main components of a rangehood 1 shown in FIG. 1. The rangehood 1 has a housing 100. Housing 100 has a number of outside walls defining a cavity for venting air and cooking fumes 3 from the cook top 2. The housing 100 or the cavity defined therein is divided into a first chamber 110 (or also may be called inlet chamber, ingress chamber, lower chamber) and a second chamber 120 (or also may be called outlet chamber, exhaust chamber, egress chamber, upper chamber). The first chamber 110 and the second chamber 120 may be divided by a divider such as divider panel 130 or any other suitable divider. An aperture in the nature of a hole 132 is provided in the divider panel 130, permitting air communication between the first and second chambers 120. An exhaust fan assembly 200 is mounted inside the rangehood housing 100, for example, removably secured to the divider panel 130. An annular airflow director 300 is mounted below the exhaust fan assembly 200, and may be conveniently attached to the exhaust fan assembly or the divider panel. Annular airflow director 300 includes a grease collector for collecting grease 4 contained in air and cooking fumes 3 and condensed inside housing 100. An air duct connector 500, which may be placed on top of or next to the fan, may be used to connect the rangehood to an air duct system to exhaust the cooking fumes outside the kitchen.

Figure 3:
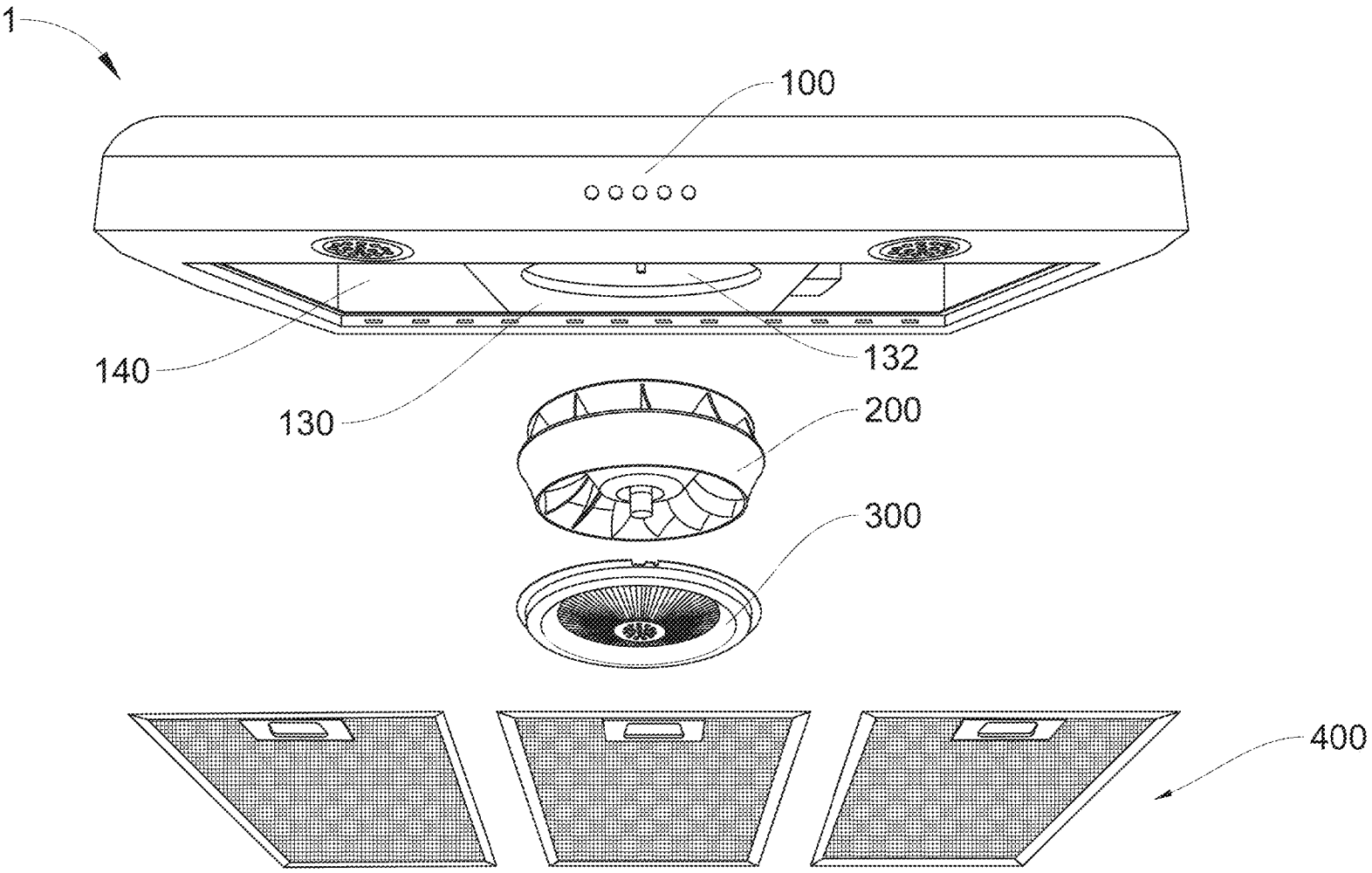
FIG. 3 is an exploded perspective view of a rangehood shown in FIG. 1.

FIG. 3 shows in an exploded perspective view a rangehood 1, illustrating more clearly its housing 100, the divider 130, its exhaust fan assembly 200 and its annular airflow director 300. Optionally, rangehood 1 also may be provided with a filter assembly 400 which may comprise one or more filters, that may be in the form of a mesh filter or a baffle filter, or any other suitable filter that may prevent dirt or grease from the airflow from passing therethrough but may still minimize the restrictions on the flow of air.

Figure 4:
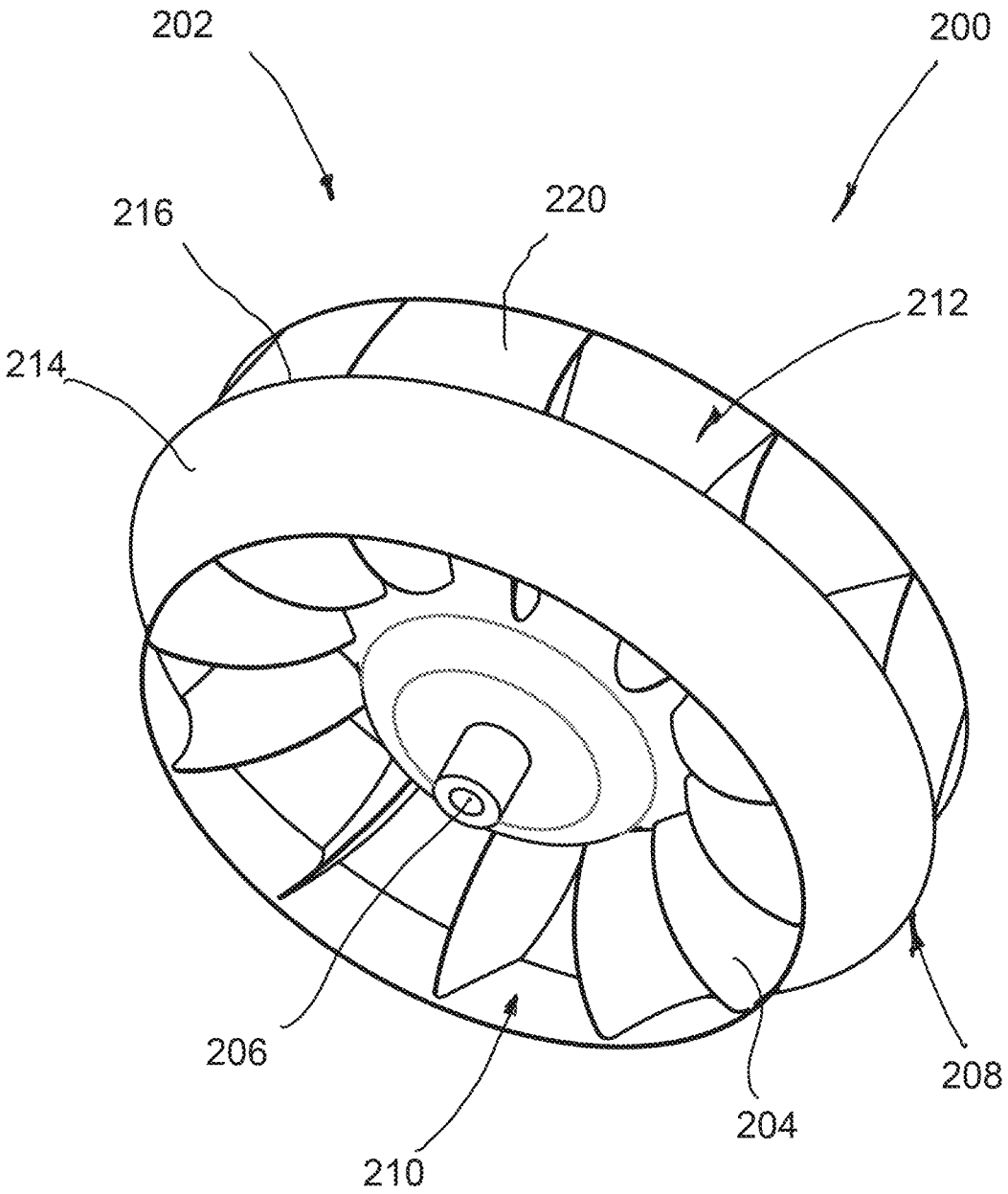
FIG. 4 is a perspective view of a fan unit of the rangehood shown in FIG. 3.
Figure 5:
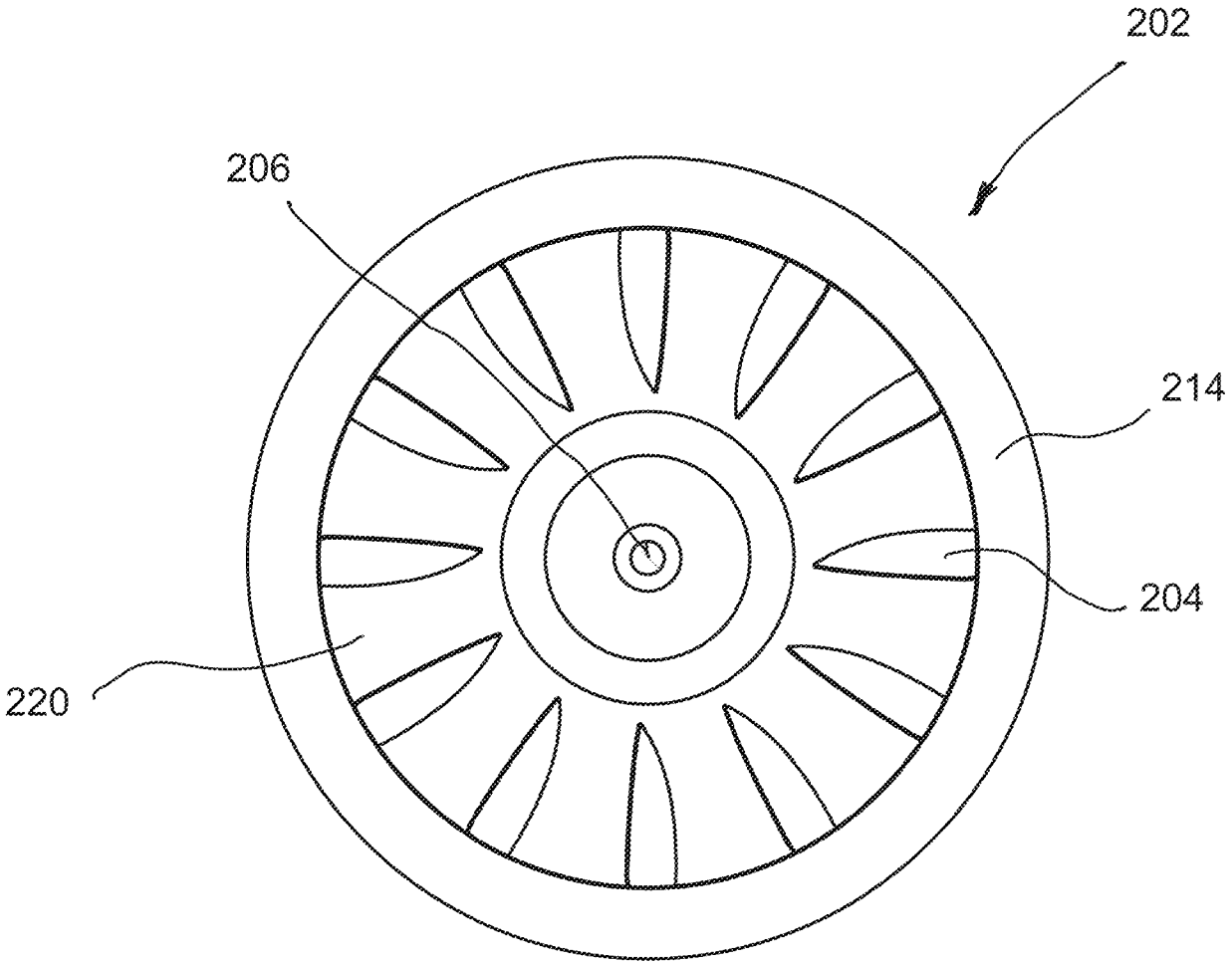
FIG. 5 is a top view of the fan unit shown in FIG. 4.

Referring to FIG. 4, the fan assembly 200 includes a fan unit, which may be an axial fan 202 that has a number of blades 204 attached or connected to a central support, such as a shaft 206, among others, and driven by a motor (not visible). When the central shaft is rotated about its axis, the exhaust fan draws the air from the first chamber 110 and exhausts the air into the second chamber 120. The first chamber 110 has an inlet opening, such as a lower opening 140 provided at the lower side of the rangehood housing 100. The second chamber 120 has an outlet opening 142, which may be above the fan unit or at the side of the fan unit or any other suitable location inside the housing, for guiding exhausted air through a duct or other means to the outside of the kitchen.

Figure 7:
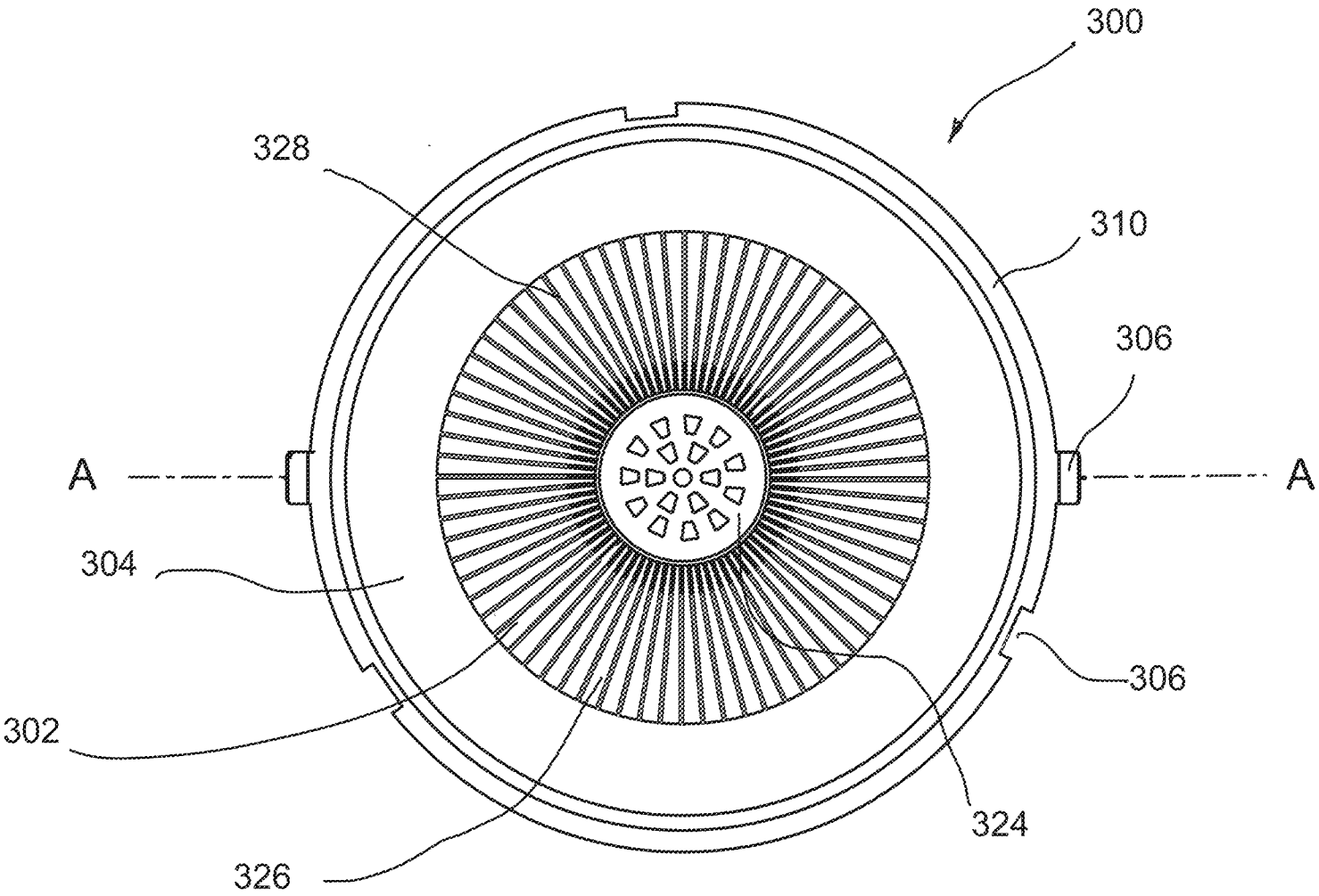
FIG. 7 is a top view of an airflow director of the rangehood shown in FIG. 3.
Figure 8:
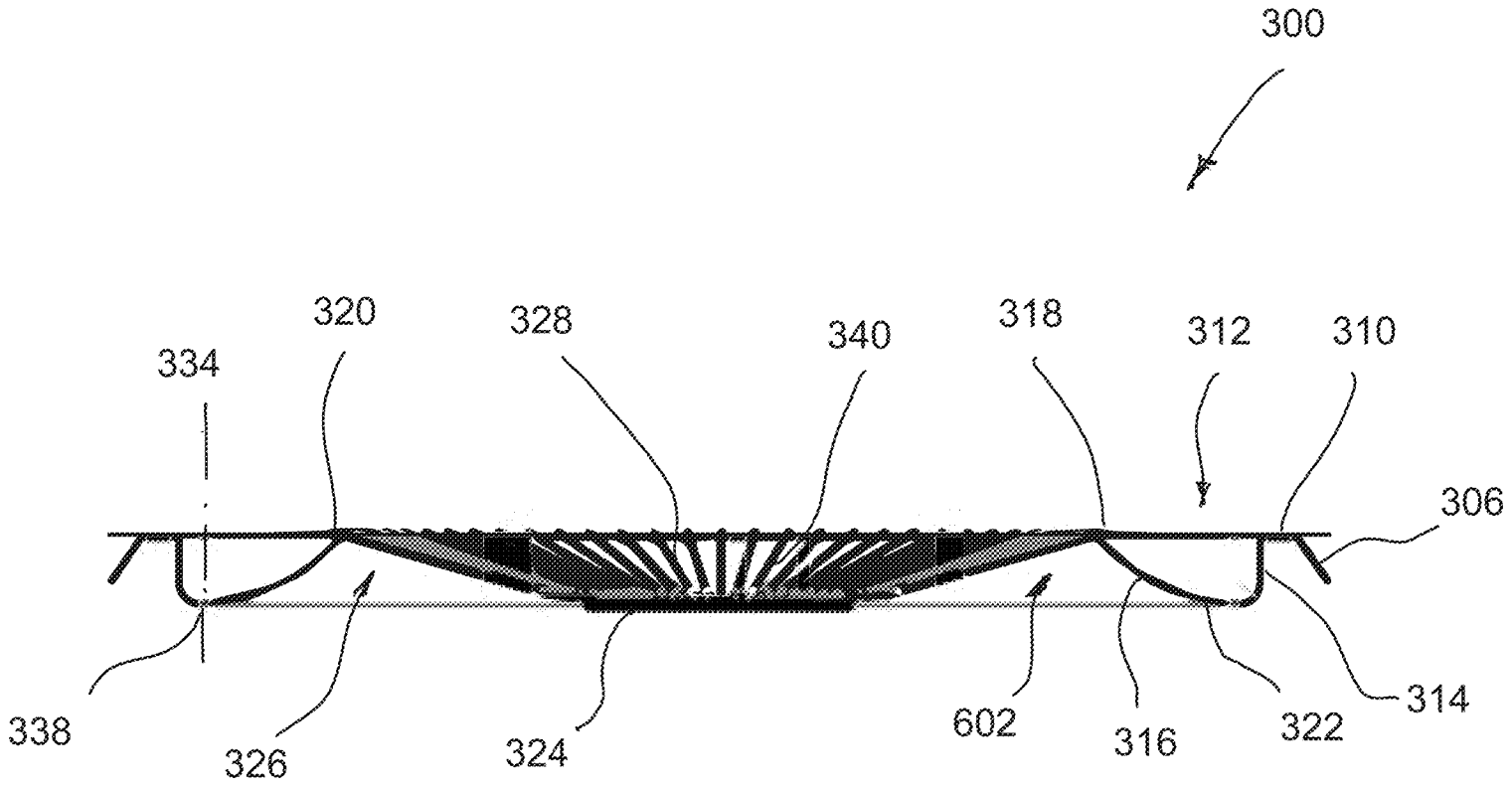
FIG. 8 shows in a side cross-sectional view, taken along line A-A in FIG. 7, an airflow director of the rangehood shown in FIG. 3.

As more clearly shown in FIG. 7 and FIG. 8, the annular airflow director 300 has a central opening 302 and an annular trough 304 surrounding the central opening 302. Annular trough is suitably shaped to form an airflow guide to direct or guide flow of air drawn by the exhaust fan assembly 200, as will be further described. The annual trough 304 also may function to collect grease 4 dripping down from the exhaust fan assembly 200, as will be described in detail later.

Referring to FIG. 3, a filter assembly 400 may be installed at the lower opening 140 of first chamber 110, to prevent dirt or grease in the airflow from accumulating inside the rangehood housing or on the fan assembly (and in particular its blades). The filter assembly 400 may be removably received in and mounted to the lower opening 140 of the first chamber, thus to filter any airflow drawn into the first chamber by the fan assembly 200. The filter assembly 400 may comprise one or more mesh filters or one of more baffle filters, or a combination of mesh filter(s) and baffle filter(s), or any other suitable filters that may prevent dirt or grease in the airflow from passing therethrough but may still minimize the restrictions on the flow of air.

Figure 6:
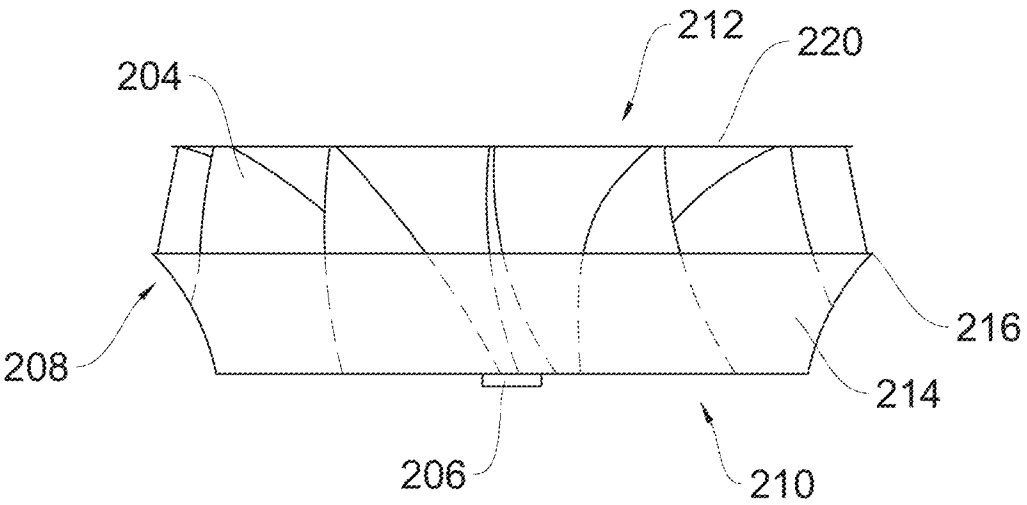
FIG. 6 is a side view of the fan unit shown in FIG. 4.

Referring to FIG. 4 again, the exhaust fan assembly 200 shown in FIG. 4 has an axial fan 202, with two openings, an ingress opening and an egress opening. The ingress opening communicates with or is connected to the first chamber or inlet chamber 110. The egress opening communicates with or is connected to the second chamber or exhaust chamber 120. Air and cooking fumes are drawn from its ingress side 210 or ingress opening into the fan unit along the length of the shaft 206 towards its egress side 212 and exit at the egress opening. The axial fan 202 may be a cyclonic axial fan, having a number of curved blades 204 which may be confined in and joined to a curved ring wall 214. A top support plate 220 joins the blades 204 together, such that the blade 206, the ring wall 214 and the support plate 220 are joined together to form a fan wheel 208. Fan wheel 208 is joined or connected to the shaft 206, such that when the shaft 206 is rotated (e.g., when energized by the motor), the fan wheel 208 draws in air and also causes a cyclonic air flow in its vicinity. Referring to FIG. 2 and FIG. 6, when viewed from its side, the ring wall 214 is tapered toward the ingress side 210, i.e., has a smaller opening at the ingress side 210 than at the middle 216 of the fan. The ring wall 214 is also curved, and concaved inwards towards the central shaft 206.

The ring wall 214 encircle a cavity 502 around the fan blades 206. Air exits from the openings between these blades 206. Rotation of fan wheel 208 generates a cyclonic air flow inside the cavity 502 and also in the vicinity of the fan wheel 208. It is also inside this cavity where any grease condensed on the fan blades 204 may be thrown off towards the inner surface 222 of the ring wall 214, such that grease in the exhausted airflow may condense and accumulate on the inner surface 222, and then subsequently drip down along the ring wall 214, or more particularly, along the inner surface 222, to be collected.

Figure 9:
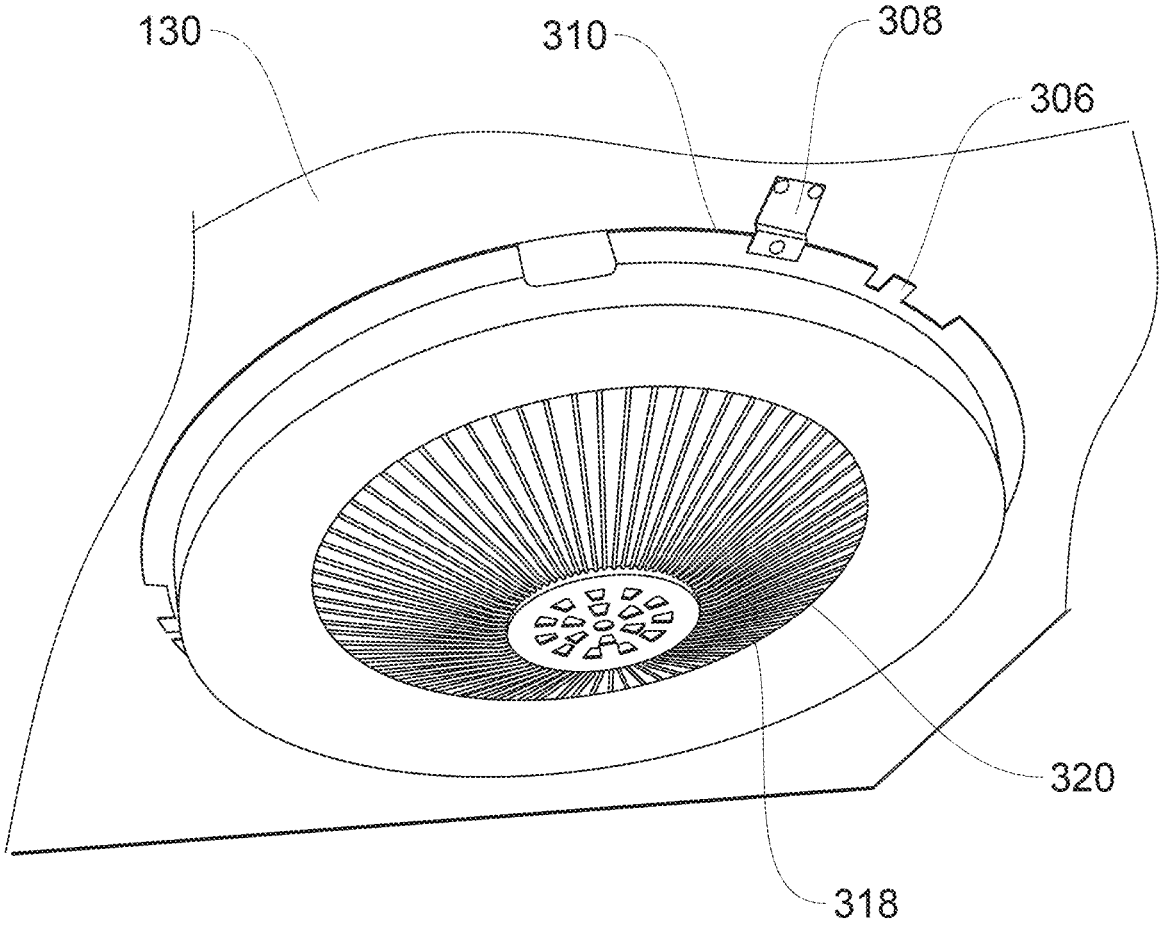
FIG. 9 shows in a perspective view an airflow director of the rangehood shown in FIG. 3.

Referring to FIG. 7 and FIG. 9, annular airflow director 300 has a number of connectors 306 such as tabs, notches, clips or any other suitable connectors (such as screws or nuts among others) that engage with cooperating connecting structures formed on the housing for removably mounting the annular airflow director 300 to the housing 100. For example, cooperative counterpart clips 308 (or holes) may be formed on (or in) the divider panel to connect with or receive the connectors 306 (such as notches or tabs or simply outer peripheral flange 310 itself) to mount the annular airflow director 300 to the divider panel 130 as illustrated in FIG. 9, or to the exhaust fan assembly (not shown). These connectors 306 are generally located at the outer periphery 310 of the annular airflow director 300, for example, on an outer peripheral flange 310. Conveniently, clips 308 also may directly engage the outer peripheral flange 310 to secure the airflow director 300 to the divider panel 130.

Figure 10:
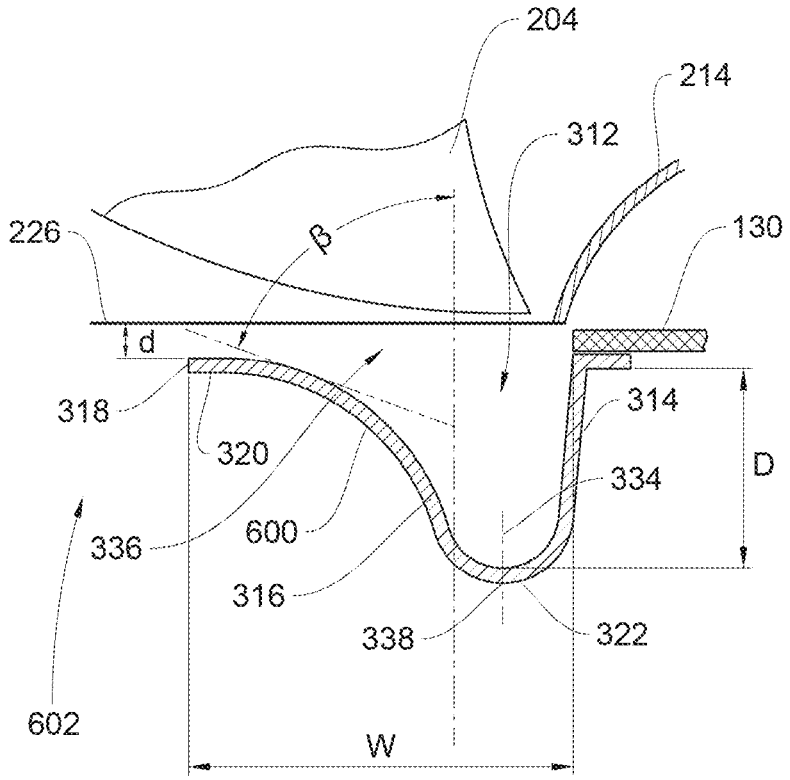
FIG. 10 is a cross-sectional view showing portion of an airflow director that includes its trough and also shows a portion of the fan unit of a rangehood shown in FIG. 1.

Referring to FIG. 8 and FIG. 10, annular trough 304 of annular airflow director 300 has a trough opening 312 generally facing upwards when the annular airflow director 300 is in installed position. This way, the annular trough 304 functions as a grease collector, so that grease dripping down from the ring wall 214 may fall into the trough 304 to be collected and cleaned. The annular trough 304 has an annular outer wall 314 and a radially inwardly spaced annular inner wall 316 that are connected by a bottom wall 322, to form the trough. The bottom wall 322 connects to the annular inner wall 316 and the outer wall 314 smoothly, i.e., with no sharp corners. In other words, the trough has a smooth, continuous profile in a cross-sectional view, as shown in FIG. 8 and FIG. 10.

In one embodiment, as seen in FIG. 7 and FIG. 8, the annular airflow director 300 includes a central hub 324. The central hub 324 thus occupies and blocks a central portion of the central opening 302. Between the central hub 324 and the inner wall 316 of the trough 304 is an annular opening 326, instead of the unblocked central opening 302. Attached to the central hub 324 are a number of generally radially arranged spokes 328, such as wires, which may be made of metal. These spokes 328 extend from the central hub 324 to an inside periphery 318 of the inner wall 316, i.e., the inner terminus edge of the inner wall, such as an inner edge flange 320, to form a protective grill 340. This protective grill 340 attaches the central hub to the inner wall of the trough 304. This protective grill 340 also help avoidance of risks to injury that may be caused by blades 204 when the exhaust fan 202 is energized. The central hub 324 may have a number of holes formed thereon to permit air and cooking fumes to pass therethrough. A grease cup (not shown) may be attached to the central hub 324 to collect any grease dripping down along and from the radially arranged spokes 328. To facilitate grease dripping down along the spokes 328, the spokes 328 may be arranged to extend radially inwardly and downwardly toward the central hub 324.

Referring to FIG. 10, the outer wall 314 of the trough 304 has a diameter sized for receiving grease collected by and dripping from the ring wall 214 of the exhaust fan assembly. It may be sized slightly larger than the diameter of the ring wall 214. In general, the diameter of the center line 334 (represented by the lowest point or circle of the bottom wall 322) of the trough 304 is comparable to, i.e., slightly larger than or slightly smaller than or the same as the diameter of the ring wall 214. The trough 304 has a width W, which is measured radially and is the distance between its outer and inside peripheries. The width W of trough 304 may not be too large so as to obstruct or restrict the airflow. In general, it may be about ⅓ to ¼ of the radius of the outer wall 314. In one embodiment of an annular airflow director 300 such as the one shown in FIG. 7 and in FIG. 8 that includes a central hub 324, an annular opening 326 is formed between the central hub 324 and the inner wall 316 of the trough. The width of the trough 304, the width w of the annular opening 326, and the radius of the central hub 324 may have a ratio of about 1:2:0.5

The ring wall 214 of the exhaust fan 202 generally encloses the fan blades 204 therein, so that air drawn by the fan 202 from surrounding air, through opening of the annular airflow director 300, is driven axially towards the egress end 212, exiting through the openings formed between the blades 204. The ring wall 214 may take a concave shape. The concave shape of the ring wall 214 and joining of blades 204 to the ring wall 214 assist generation of a cyclonic air flow. The concave shape of the ring wall 214 also assists downward dripping of grease condensed and accumulated on the ring wall 214.

In an installed state, i.e., when the exhaust fan assembly 200 is mounted inside the housing 100 and the annular airflow director 300 is mounted below the exhaust fan 202 and inside the first chamber 110, rotation of the blades 204 produces a cyclonic air flow inside the space defined by the interior of the ring wall 214 and the annular airflow director, and in particular the space encircled by the ring wall 214 of the exhaust fan assembly 200 and space extending from the lower edge 226 of the fan to the bottom of the annular airflow director 300. The annular airflow director 300 is spaced away from the exhaust fan 202, for creating this space 336. As illustrated in FIG. 2, this space 336 generally spans between the top 224 of the fan 202, such as support plate of the fan 202, and the bottom 338 of the annular airflow director 300 (the bottom 338 is generally represented by the center line 334, or the lowest point or circle of the bottom wall 322). More particularly, it is the part of the space defined by the support plate and the ring wall that is where the cyclonic air motion is the strongest. In one embodiment, annular airflow director 300 is mounted such that its inside periphery 318, or the inner edge flange 320 of the inner wall 316, if the flange is provided, is spaced from the bottom edge 226 of the ring wall 214 by a distance d. This distance d is measured in a direction along the axial fan's axis, that is a fraction of the diameter of the opening of the exhaust fan 202, i.e., the diameter R of the ring wall 214. In one embodiment, d may be about ⅓ or ¼ of R. In general, d may be in the range of 1/10 to ½ of R. It is also contemplated that the annular airflow director 300 may be placed directly adjacent the exhaust fan 202, such that the connectors 306 arranged along the outer periphery 310 or the outer peripheral flange 310 of the annular airflow director 300 directly connect annular airflow director 300 to the fan 202, provided that the trough 304 has a sufficient depth D and the inner edge flange 320 or the inside periphery 318 of the inner wall 316 is sufficiently spaced away from the exhaust fan 202, to permit enough cyclonic air flow motion to be generated.

Referring to FIG. 10, the annular trough 304 may have a generally straight outer wall 314. To further increase the effectiveness of exhaust fan 202, the inner wall 316 may be inclined to create a trumpet-shaped air guide 600 (not shown exactly to scale, in order to better illustrate the trumpet-like shape), to facilitate increase of airflow volume drawn into the first chamber 110 by the exhaust fan 202 from the surrounding air. The air guide 600 has its guide opening 602 gradually decreasing in a direction toward the fan 202. The annular inner wall 316 is generally inclined to provide such a smaller opening towards the fan 202 and a larger opening away from the fan. The inclined inner wall 316 forms an angle β with the rotor shaft 206 generally in the range of 60 degrees to 80 degrees (or when measured against a plan orthogonal to the rotational axis, an angle between 10 degrees and 30 degrees), and may be, for example, 70 degrees, 75 degrees, or 80 degrees. The inclination angel β may be suitably adjusted, according to parameters such fan speed, volume of air driven by the fan per second, opening area of the fan, distance between the fan and the annular airflow director, among others, to maximize the effectiveness.

Additionally or alternatively, the inner wall 316 may also be curved, instead of being a straight wall. For examiner, the inner wall 316 may be curved and concaved inward toward the air guide 602 (i.e., concaved toward the central shaft 206) as shown in FIG. 8. The inner wall 316 also may be curved and concaved inwards toward the interior of the trough 304 (i.e., concaved away from the central shaft 206) as shown in FIG. 10. This curved and concaved inner wall 316, together in combination with the curved bottom wall, further improves the air and cooking fumes exhaust and the creation of cyclonic air flow movement inside the housing. The curvature of how much the inner wall 316 concaves (either inward towards the air guide 602 or towards the interior of the trough 304) also may be suitably adjusted according to parameter such as fan speed, volume of air driven by the fan per second, opening area of the fan, distance between the fan and the annular airflow director, among others.

Various embodiments of the invention have now been described in detail. It will be understood by those skilled in the art, and is intended by the inventor, that any one or more of any technical feature, whether described as particular examples or in the summary, may be combinable with any other one or more of any of these technical feature unless explicitly stated otherwise. Those skilled in the art will appreciate that numerous modifications, adaptations and variations may be made to the embodiments without departing from the scope of the invention, which is defined by the appended claims. The scope of the claims should be given the broadest interpretation consistent with the description as a whole and not to be limited to these embodiments set forth in the examples or detailed description thereof.

What is claimed is:

1. A kitchen rangehood for a cook top comprising:

a housing having outside walls defining a cavity for venting air and cooking fumes from the cook top, the housing including a divider to divide the cavity into a first chamber and a second chamber, the divider having an aperture formed therein to permit air communication between the first chamber and the second chamber, the first chamber having an inlet opening for receiving the air and cooking fumes;

an exhaust fan assembly mounted inside the housing, the exhaust fan assembly having an ingress opening communicating with the first chamber and an egress opening communicating with the second chamber, wherein the exhaust fan assembly comprises an axial fan, the axial fan having a ring wall housing; and an airflow director mounted below the exhaust fan assembly, the airflow director having a central opening and a ring trough formed around the central opening, the central opening permitting the air and cooking fumes to pass therethrough, the ring trough having an inner wall, a radially outwardly spaced outer wall, and a bottom wall connecting the inner wall and the outer wall to form the ring trough, the inner wall being shaped for directing the airflow and fumes toward the central opening, and the ring trough forming a grease tray and positioned below the exhaust fan assembly for collecting grease condensed on and dripping down from the exhaust fan assembly and the housing, wherein the inner wall forms a trumpet-like air guide, the larger opening of the trumpet-like air guide facing away from the axial fan, the ring wall of the axial fan being concaved radially inwardly towards a central axis of the axial fan, and wherein the airflow director further comprises a central hub disposed in a central location of the central opening which divides the central opening into an annular opening and a central portion occupied by the central hub, the airflow director further comprises a protective grill connecting the central hub to the airflow director.

2. The kitchen rangehood of claim 1, wherein the trumpet-like air guide is concaved radially outwards toward the interior of the ring trough.

3. The kitchen rangehood of, claim 1, wherein the ring trough has a width W and the annular opening has a width w, and the annular trough and the annular opening are sized such that W is about ⅓ to ¼ of the radius of the outer periphery of the annular trough.

4. The kitchen rangehood of, claim 1, wherein the ring trough has a width W and the annular opening has a width w, and the annular trough and the annular opening are sized such that W:w has a ratio of about 1:2.

5. The kitchen rangehood of claim 3, wherein the central hub is sized such that the width W of the trough, the width w of the annular opening, and the radius of the central hub has a ratio of about 1:2:0.5.

6. A kitchen rangehood for a cook top comprising:

a housing having outside walls defining a cavity for venting air and cooking fumes from the cook top, the housing including a divider to divide the cavity into a first chamber and a second chamber, the divider having an aperture formed therein to permit air communication between the first chamber and the second chamber, the first chamber having an inlet opening for receiving the air and cooking fumes;

an exhaust fan assembly mounted inside the housing, the exhaust fan assembly having an ingress opening communicating with the first chamber and an egress opening communicating with the second chamber, wherein the exhaust fan assembly comprises an axial fan, the axial fan having a ring wall housing; and an airflow director mounted below the exhaust fan assembly, the airflow director having a central opening and a ring trough formed around the central opening, the central opening permitting the air and cooking fumes to pass therethrough, the ring trough having an inner wall, a radially outwardly spaced outer wall, and a bottom wall connecting the inner wall and the outer wall to form the ring trough, the inner wall being shaped for directing the airflow and fumes toward the central opening, and the ring trough forming a grease tray and positioned below the exhaust fan assembly for collecting grease condensed on and dripping down from the exhaust fan assembly and the housing, wherein the inner wall forms a trumpet-like air guide, the larger opening of the trumpet-like air guide facing away from the axial fan, the ring wall of the axial fan being concaved radially inwardly towards a central axis of the axial fan, and wherein the inner wall is inclined radially inwardly and forms an inclination angle with the central axis in a range of 60 degrees to 80 degrees.

7. The kitchen rangehood of claim 6, wherein the inclination angle is about 75 degrees.

8. The kitchen rangehood of claim 6, wherein the airflow director further comprises a central hub secured to the annular trough defining an annular opening between the central hub and the annular trough, the ring trough has a width W and the annular opening has a width w, and the annular trough and the annular opening are sized such that W:w has a ratio of about 1:2.

9. The kitchen rangehood of claim 8, wherein the trumpet-like air guide is concaved radially outwards toward the interior of the ring trough.

10. The kitchen rangehood of claim 9, wherein the annular trough has an inside periphery, and the airflow director is mounted to the housing to space the inside periphery from the axial fan along an axial direction.

11. The kitchen rangehood of claim 10, wherein the inside periphery is spaced from the axial fan at a distance about 1/10 to 1/2 of the diameter of the ring wall.

12. The kitchen rangehood of claim 11, wherein the inside periphery is spaced from the axial fan at a distance of about 1/3 of the diameter of the ring wall.

13. The kitchen rangehood of claim 11, wherein the inside periphery is spaced from the axial fan at a distance of about 1/4 of the diameter of the ring wall.

14. The kitchen rangehood of claim 1, further comprising a protective grill covering the central opening.

15. The kitchen rangehood of claim 14, wherein the protective grill comprises a plurality of wires extending downwardly and radially toward a central hub.

16. The kitchen rangehood of claim 14, further comprising a filter unit mounted to the housing, the filter unit covering the inlet opening.

* * * * *